US006213459B1

(12) United States Patent
Cote et al.

(10) Patent No.: US 6,213,459 B1
(45) Date of Patent: Apr. 10, 2001

(54) SIGNATURE GRIPPER AND DELIVERY DEVICE

(75) Inventors: Kevin Lauren Cote, Durham; Paul Emmett Bredenberg, Portsmouth, both of NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/113,761

(22) Filed: Jul. 10, 1998

(51) Int. Cl.[7] ..... B65H 29/46

(52) U.S. Cl. ..... 271/85; 271/82; 271/204; 271/205; 271/206

(58) Field of Search ..... 271/204, 205, 271/206, 82, 85; 198/802, 474.1; 294/103.1, 34

(56) References Cited

U.S. PATENT DOCUMENTS

| | | | | |
|---|---|---|---|---|
| 4,072,260 | * | 2/1978 | Dove | 226/173 |
| 4,647,031 | * | 3/1987 | Smith et al. | 271/82 |
| 4,953,847 | * | 9/1990 | Honegger | 271/277 |
| 4,982,944 | * | 1/1991 | Eberle | 271/204 |
| 5,048,815 | * | 9/1991 | Bergmeier et al. | 271/204 |
| 5,465,952 | * | 11/1995 | Eberle et al. | 271/204 |
| 5,501,443 | | 3/1996 | Cote et al. . | |
| 5,727,783 | * | 3/1998 | Tassinari | 271/185 |
| 5,740,900 | * | 4/1998 | Cote et al. | 198/436 |
| 5,975,280 | * | 11/1999 | Cote et al. | 198/474.1 |
| 5,992,610 | * | 11/1999 | Dufour et al. | 198/377.06 |

FOREIGN PATENT DOCUMENTS

| | | | | |
|---|---|---|---|---|
| 0326533 | * | 8/1989 | (EP) | 271/205 |
| 8907571 | * | 8/1989 | (WO) | 271/204 |

* cited by examiner

*Primary Examiner*—Donald P. Walsh
*Assistant Examiner*—David Jones
(74) *Attorney, Agent, or Firm*—Kenyon & Kenyon

(57) ABSTRACT

A signature gripper having a gripper pad for firmly gripping a signature; a gripper base connected to the gripper pad, the gripper pad being rotatable about the gripper base in a direction of rotation; and a spring acting in the direction of rotation to permit rotation of the gripper pad about the gripper base and connected to at least one of the gripper base and gripper pad. The spring damps deceleration experienced by the signature upon gripping.

6 Claims, 4 Drawing Sheets

H
H
H

SIGNATURE GRIPPER AND DELIVERY DEVICE

FIELD OF THE INVENTION

The present invention relates generally to a delivery systems for signatures printed by a printing press, and more particularly to a signature gripper.

RELATED TECHNOLOGY

Signature conveyance devices are known, for example, which use grippers to grasp a stream of signatures exiting a folder. The grippers can travel on a conveyance device, such as disclosed in U.S. Pat. No. 5,501,443, which shows a conveyor 10 having grippers 12. This patent is hereby incorporated by reference herein.

Often there is a difference between the velocity of the signatures as they exit the folder and the velocity of the grippers in the conveyance device. The signatures thus may experience a deceleration when first gripped by the grippers. This deceleration often causes a skew or torque as the center of gravity of the signature attempts to rotate about the gripper, which firmly grasps the signature at a side location. This skew or torque can damage the signature and affect print quality, or worse, cause a rip or tear in the signature. Signature handling problems also may arise if the signature is not in the correct orientation with respect to its gripper.

SUMMARY OF THE INVENTION

The present invention provides a signature gripper having a gripper pad for firmly gripping a signature, a gripper base connected to the gripper pad, the gripper pad being rotatable about the gripper base in a direction of rotation, and a spring acting in the direction of rotation to permit rotation of the gripper pad about the gripper base and connected to at least one of the gripper base and gripper pad.

The present invention also provides a signature delivery device comprising a conveyance device and a plurality of such grippers.

Advantageously, a normal of the signature and an axis of rotation of the gripper pad are parallel, so that the rotation of the gripper pad can best follow the rotation of the signature.

DETAILED DESCRIPTION

Figure 1:
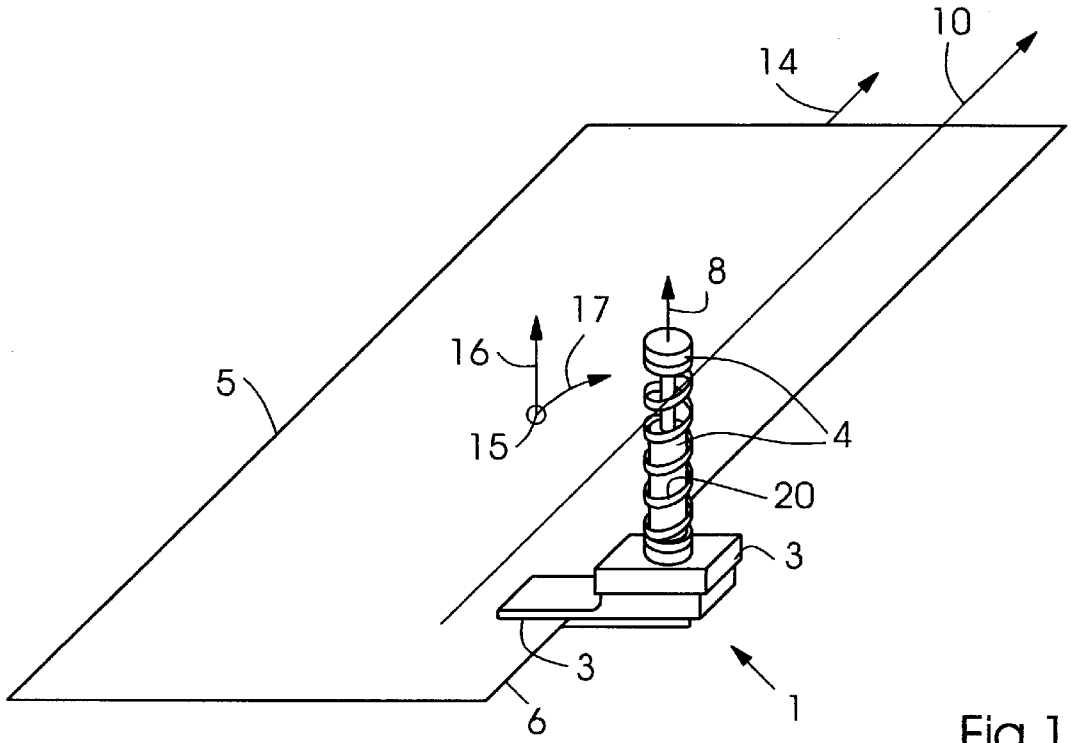
FIG. 1 shows a gripper of the present invention attached to a schematic representation of a conveyance device.
Figure 3:
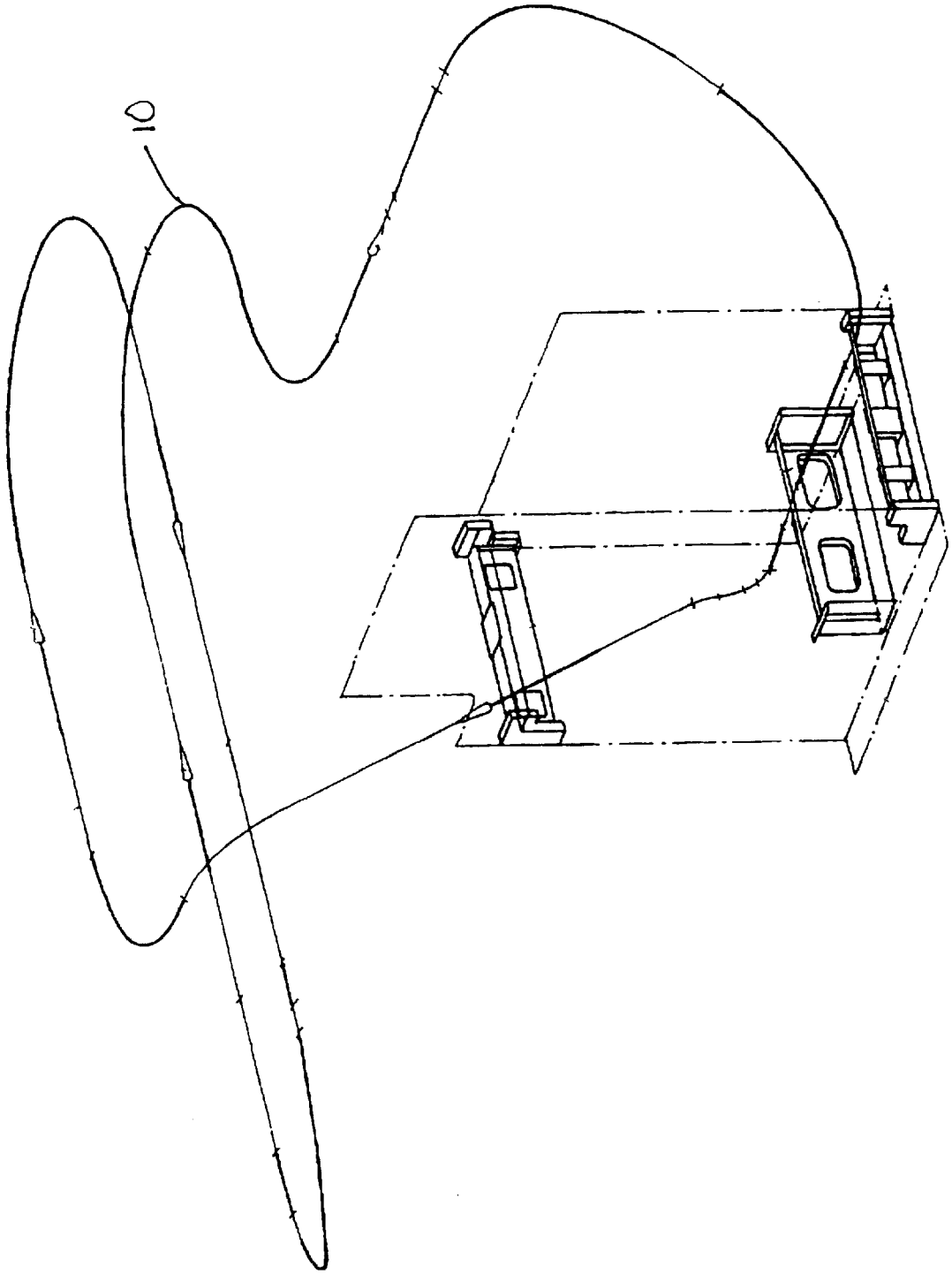
FIG. 3 is a schematic view of a prior art conveyor mechanism.
Figure 4:
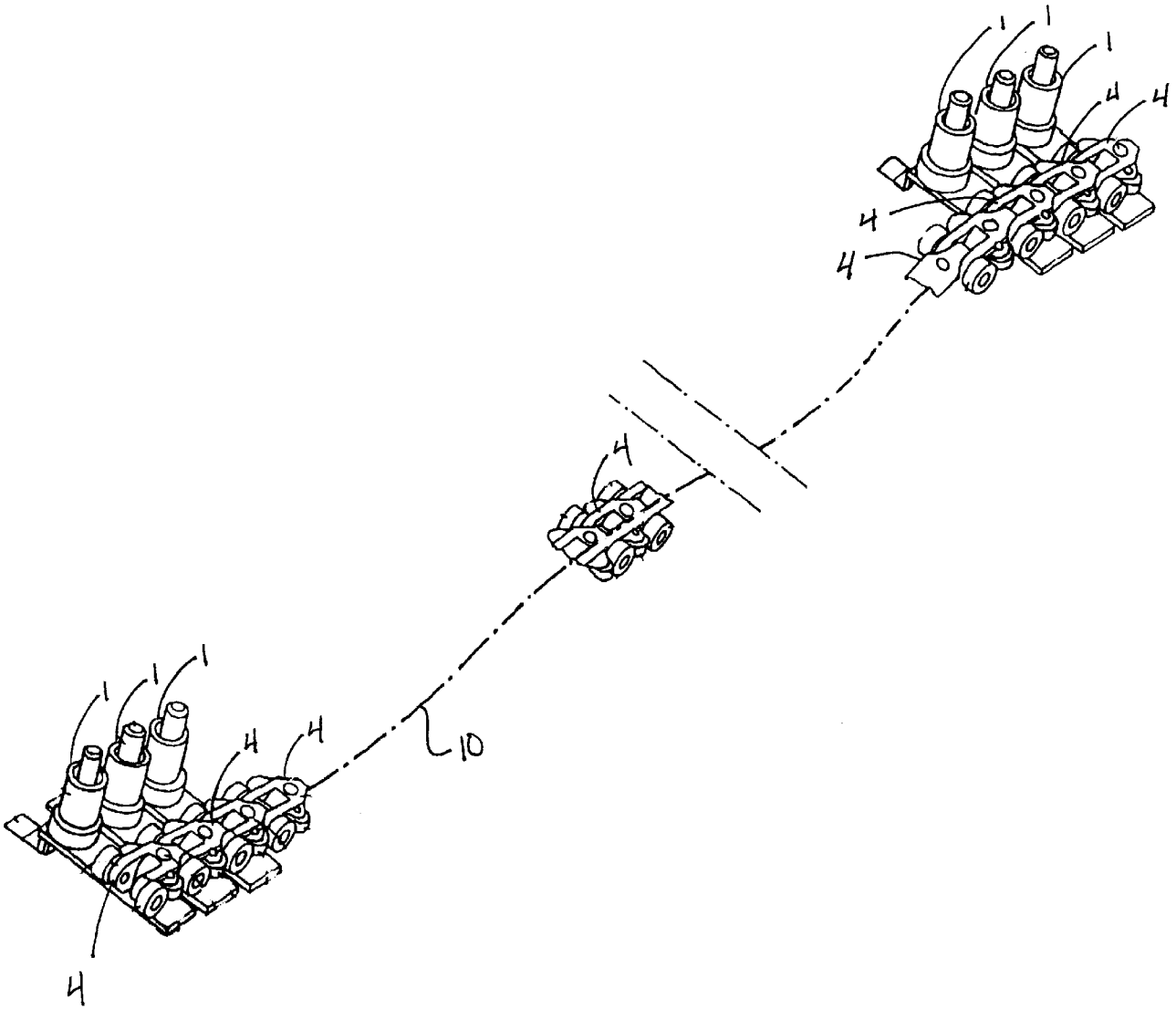
FIG. 4 shows a plurality of prior art grippers traveling along a conveyor path.
Figure 5:
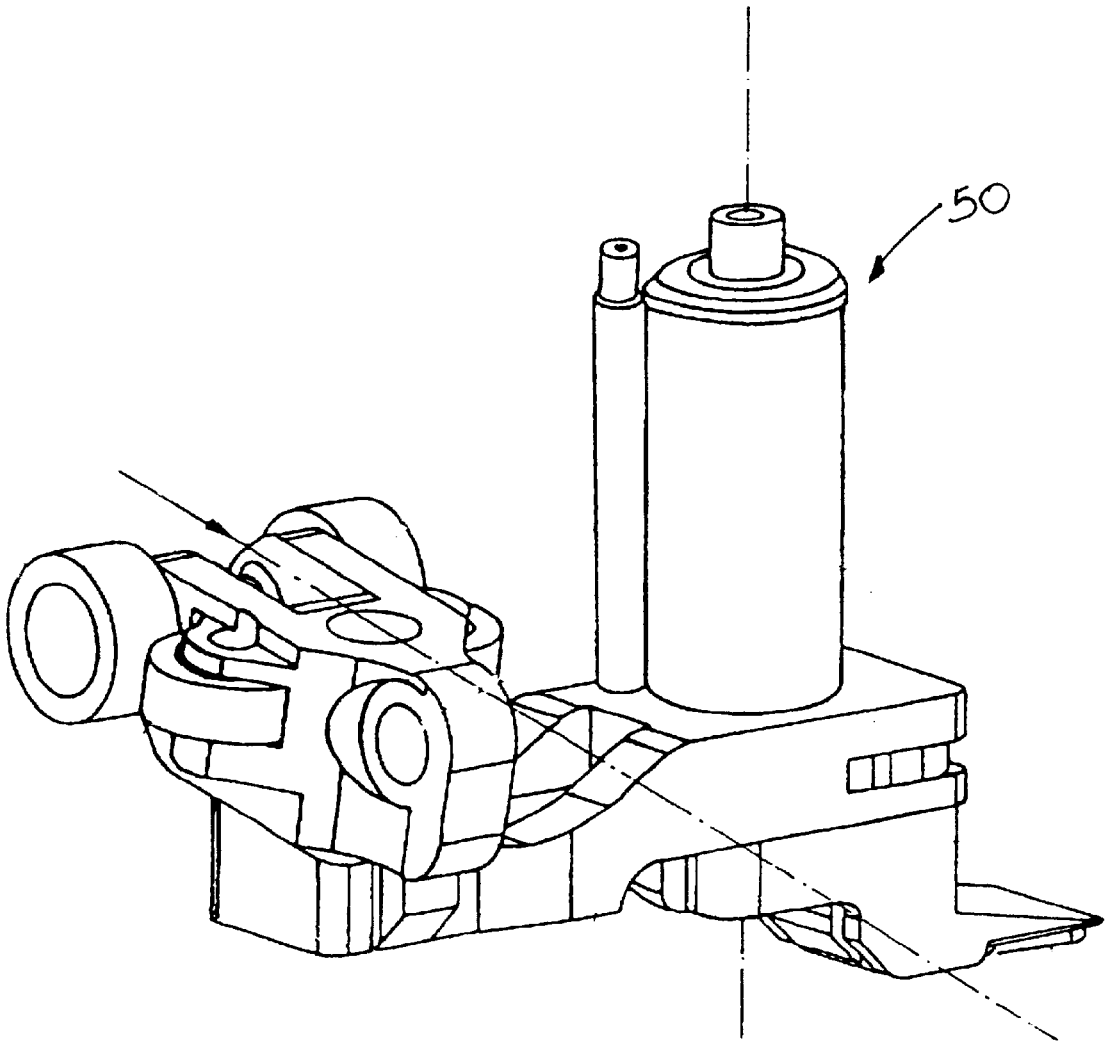
FIG. 5 shows a prior art gripper.

FIG. 1 shows a gripper 1 for gripping a signature 5. The gripper 1 includes a gripper pad 3 for firmly grasping the signature 5, and a gripper base 4. The gripper pad 3 is rotatable about an axis 8 with respect to the gripper base 4. The gripper base 4 runs in or is an integral part of a conveyance device 10, which is shown schematically in FIGS 3 and 4. The gripper base 4 preferably is not rotatable with respect to the conveyance device 10. The base can be non-rotatable in any manner known to those skilled in the art. For example, FIG. 5 shows an example of a prior art mechanism using a similar gripper mechanism 50 which is non-rotatable with respect to the conveyor device. The conveyance device 10 can transport a plurality of grippers at a conveyance velocity.

The signature 5 enters the conveyance device having a delivery velocity, indicated at arrow 14. Preferably the signature 5 is traveling in the same direction as the conveyance device 10 when entering the conveyance device 10. The signature 5 has a center of gravity 15, and a normal 16 to the plane of the signature. As the signature 5 is grasped at a side 6 by the gripper pad 3, the center of gravity 15 attempts to rotate clockwise about the gripper pad 3 as shown by arrow 17.

Fastened about the gripper base 4 is a torsion spring 20, which is firmly connected to the gripper base 4 at the top of the spring and to the gripper pad 3 at the bottom. The gripper pad 3 is rotatably connected to the gripper base 4, although either the gripper pad 3 and gripper base 4 preferably has a stop (not shown) to prevent rotation of the gripper pad 3 in one direction (as shown, in the counterclockwise direction) with relation to the gripper base 4. The torsion spring 20 acts to force the gripper pad 3 counterclockwise to gripper base 4 and opposite to the direction of arrow 17.

Figure 2:
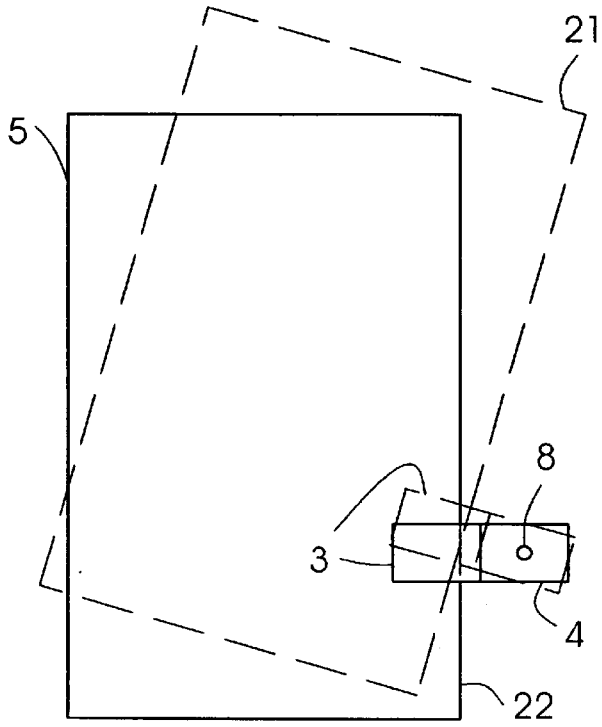
FIG. 2 is a top view of the gripper of the present invention.

As the center of gravity 15 of the signature 5 begins to rotate about the gripper pad 3 in the clockwise direction, the gripper pad 3 thus also rotates about the gripper base 4 in the clockwise direction about rotational axis 8. The force of the spring 20 counteracts this motion, but has such a spring constant so as to permit a gentle rotation of the gripper pad 3 about the gripper base 4 as the signature is first gripped to a first location 21, as shown in FIG. 2 in dashed lines. The selection of a spring constant for the spring 20 can be a function of a number of factors, such as the typical velocity difference between the signature delivery velocity and the conveyance velocity, the strength of paper typically used for the signatures, the size and weight of signatures typically used, and the size and weight of the gripper pad.

After the deceleration is damped by the spring 20, the spring 20 can return the gripper pad to an original location 22 with respect to the gripper base.

While a torsion spring has been shown, any other type of spring may be used to damp the rotation of the gripper pad 3 with respect to the gripper base 4, the term spring being meant as a broad term for any type of damping mechanism.

The actual gripping of the signature 5 can take place in known fashion. For example, the gripper pad 3 can include a pair of jaws which can be actuated by a downward force on the gripper base 4. This method is well-known, and is described in such patents as U.S. Pat. No. 5,740,900, which describes in detail how the gripper pad is actuated by a downward force on the gripper device. Signature as used herein can be any flat printed product, including a printed sheet.

What is claimed is:

1. A signature gripper comprising:

a gripper pad for firmly gripping a signature, wherein the gripper pad has an axis of rotation and the signature has a normal, and the axis of rotation and the normal are substantially parallel;

a gripper base connected to the gripper pad, the gripper pad being rotatable about the gripper base in a direction of rotation; and a spring acting opposite the direction of rotation, the spring having a spring constant which provides a gentle force for damping rotation of gripper pad about the gripper base, the spring connected to at least one of the gripper base and gripper pad so that the gripper head dampens a force generated by a difference between a signature delivery velocity and a velocity of the gripper base.

2. The signature gripper as recited in claim 1 wherein the gripper pad has a first location with respect to the gripper base when no signature is gripped, and a second location different from the first location when the signature is first gripped.

3. The signature gripper as recited in claim 2 wherein the spring acts to return the gripper pad to the first location.

4. The signature gripper as recited in claim 1 wherein the gripper pad includes a pair of jaws for gripping the signature.

5. The signature gripper as recited in claim 1 wherein the gripper base has an axis of rotation and the signature has a normal, the axis of rotation and the normal being parallel.

6. A signature delivery device comprising:

a gripper conveyance device; and a plurality of grippers connected to the gripper conveyance device, each gripper including a gripper pad for firmly gripping a signature, a gripper base connected to the gripper pad, the gripper pad being rotatable about the gripper base in a direction of rotation, and a spring acting opposite the direction of rotation for damping rotation of the gripper pad about the gripper base, the spring being connected to at least one of the gripper base and gripper pad, the spring having a spring constant which permits a rotation of the gripper pad about the gripper base to damp rotation, and wherein the gripper pad has an axis of rotation and the signature has a normal, the axis of rotation and the normal being substantially parallel.

* * * * *